US005249558A

United States Patent [19]

Imamura

[11] Patent Number: 5,249,558

[45] Date of Patent: Oct. 5, 1993

[54] IDLE SPEED CONTROL SYSTEM FOR INTERNAL COMBUSTION ENGINE

[75] Inventor: Masamichi Imamura, Gumma, Japan

[73] Assignee: Japan Electronic Control Systems Co., Ltd., Isezaki, Japan

[21] Appl. No.: 802,636

[22] Filed: Dec. 9, 1991

[30] Foreign Application Priority Data

Dec. 17, 1990 [JP] Japan ..... 2-402803

[51] Int. Cl.[5] ..... F02D 41/08

[52] U.S. Cl. ..... 123/339

[58] Field of Search ..... 123/339, 436, 585

[56] References Cited

U.S. PATENT DOCUMENTS

| | | | |
|---|---|---|---|
| 4,492,195 | 1/1985 | Takahashi et al. | 123/339 |
| 4,509,477 | 4/1985 | Takao et al. | 123/339 |
| 4,653,449 | 3/1987 | Kamei et al. | 123/339 X |
| 4,716,871 | 1/1988 | Sakamoto et al. | 123/339 |
| 4,771,749 | 9/1988 | Kiuchi et al. | 123/339 |
| 4,785,780 | 11/1988 | Kawai | 123/339 |
| 4,860,707 | 8/1989 | Ohata | 123/339 |
| 4,971,011 | 11/1990 | Nanyoshi et al. | 123/436 |
| 5,010,866 | 4/1991 | Ohata | 123/436 |
| 5,069,181 | 12/1991 | Togai et al. | 123/339 X |

FOREIGN PATENT DOCUMENTS

| | | |
|---|---|---|
| 1-179148 | 12/1989 | Japan . |
| 3-117653 | 5/1991 | Japan . |

*Primary Examiner*—Willis R. Wolfe

*Attorney, Agent, or Firm*—Foley & Lardner

[57] ABSTRACT

An idle speed control system for an automotive internal combustion engine having an intake air passageway through which intake air flow to be inducted into engine cylinders. The idle speed control system is comprised of an auxiliary air control valve operatively disposed in an auxiliary air passage which is connected with the intake air passageway in a manner to bypass a throttle valve. The amount of air flowing through the auxiliary air passage is regulated by controlling the opening degree of the auxiliary air control valve under an idle operating condition in order to control idle speed. The control of the auxiliary air control valve opening degree is accomplished in accordance with a difference between model and actual torques of a power output shaft of the engine. The model torque is produced in time series in accordance with a target idle speed by using a model.

12 Claims, 2 Drawing Sheets

IDLE SPEED CONTROL SYSTEM FOR INTERNAL COMBUSTION ENGINE

BACKGROUND OF THE INVENTION

1. Field of the Invention

This invention relates to improvements in an idle speed control system for an internal combustion engine, and more specifically to such an idle speed control system which is high in response in air supply to engine cylinders.

2. Description of the Prior Art

A variety of idle speed control systems have been proposed and put into practical use. A typical one of them is constructed and arranged as follows: An auxiliary air passage is provided to supply an auxiliary air for idling, into an intake air passageway through which intake air flows to be inducted into the engine cylinders of an engine. The auxiliary air is arranged to bypass a throttle valve rotatably disposed in the intake air passageway and provided with an auxiliary air control valve to control the amount of air flowing through the auxiliary air passage, thereby controlling idle speed. Such idle speed control system is disposed, for example, in Japanese Utility Model Provisional Publication No. 1-179148.

The auxiliary air control valve is of the electromagnetically operated type wherein the opening degree is controlled in accordance with duty cycle (factor) ISCon (%) applied thereto. The duty cycle is represented by a time rate (%) of a pulse width relative to a predetermined control cycle in case that the opening degree of the auxiliary control valve is controlled by changing the pulse width of a pulse signal which operate the auxiliary air control valve to open and is supplied in the predetermined cycle. The duty cycle ISCon (%) is calculated according to the following equation:

$$ISCon = ISCtw + ISCcl$$

where ISCtw is a basic control value which is set depending upon an engine coolant temperature Tw and with reference to a map on ROM; and ISCcl is a feedback correction value which is obtained by a proportional-plus-integral (PI) control of the result of comparison between an actual idle speed and a target idle speed under an idle speed feedback control condition. Thus, in the conventional idle speed control system, the idle speed control is achieved by the proportional-plus-integral control upon the comparison between the actual idle speed and the target idle speed.

However, drawbacks have been encountered in such a conventional idle speed control system, as set forth below. It has been a recent trend that a collector section (at which manifold branch runners are gathered) of an intake manifold has a large volume. The large volume collector section unavoidably retains a relatively large volume of air and therefore causes a delayed response in air supply to engine cylinders thereby resulting in engine speed lowering and/or hunting.

SUMMARY OF THE INVENTION

It is an object of the present invention to provide an improved idle speed control system for an internal combustion engine, which can overcome the drawbacks encountered in conventional idle speed control systems.

Another object of the present invention is to provide an improved idle speed control system for an internal combustion engine, which is improved in response in air supply to engine cylinders of the engine during idling.

A further object of the present invention is to provide an improved idle speed control system for an internal combustion engine, which can prevent engine speed lowering and/or hunting in the engine provided with an intake manifold having a large volume collector section.

An idle speed control system of the present invention is for an internal combustion engine and comprised of an auxiliary air control valve disposed in an auxiliary air passage which is communicated at its downstream end with an intake air passageway downstream of a throttle valve. An air flow amount control device is provided to control the amount of air flowing through the auxiliary air passage so as to control an idle speed of the engine under an idle operating condition. In this air flow amount control system, a model torque of a power output shaft of the engine is produced in time series, in accordance with a target idle speed by using a model. An actual torque of the power output shaft is detected. The opening degree of the auxiliary air control valve is controlled in accordance with a difference between the model torque and the actual torque so as to control the air flowing amount in the auxiliary air passage.

Accordingly, by using the model, the idle speed control is accomplished depending upon the difference between the model torque and the actual torque of the engine power output shaft, so that the control is made like a feedforward control. As a result, stabilization of idle engine operation and idle speed lowering can be achieved improving fuel economy.

DETAILED DESCRIPTION OF THE INVENTION

Figure 1:
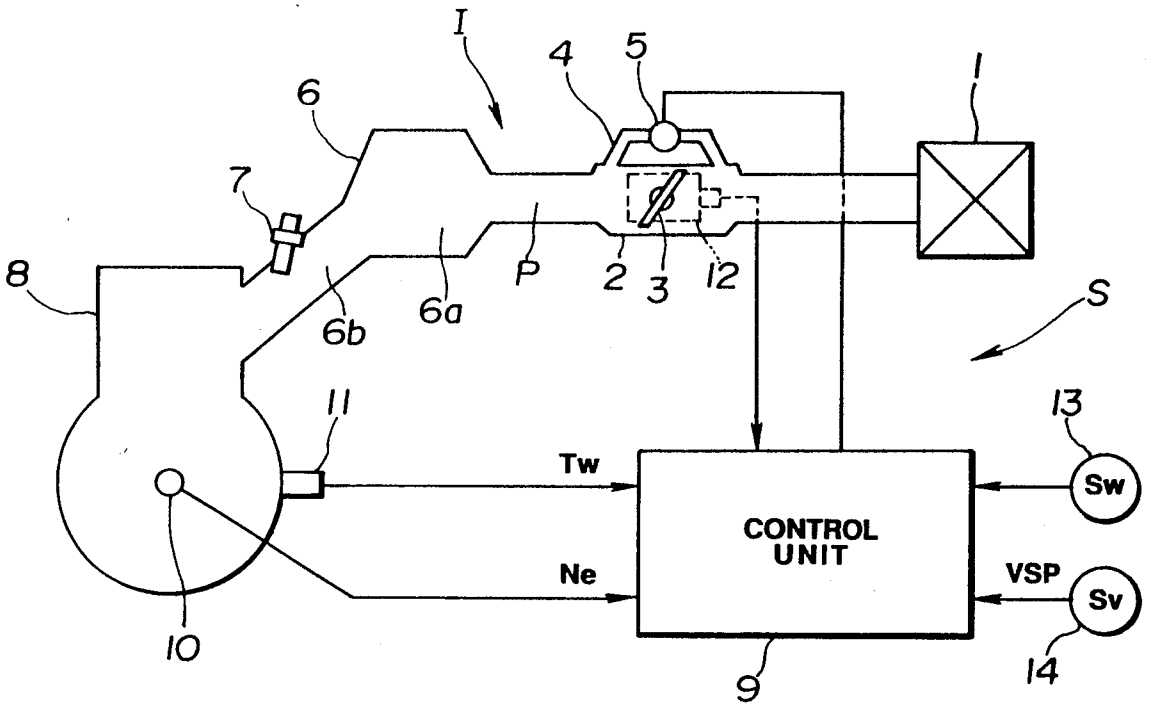
FIG. 1 is a schematic illustration of an embodiment of an idle speed control system according to the present invention.

Referring now to FIG. 1 of the drawings, an embodiment of an idle speed control system according to the present invention is illustrated by the reference character S. The idle speed control system S in this embodiment is used incorporating with an internal combustion engine 8 mounted on an automotive vehicle (not shown). The engine 8 is provided with an intake system I defining an intake air passageway P through which air flows and is sucked into the engine 8. The intake system I includes an air filter 1 which is connected with a throttle chamber 2 in which a throttle valve 3 is rotatably disposed. The throttle valve 3 is operatively connected to and in relation to an accelerator pedal (not shown). The throttle chamber 2 forms part of the intake air passageway P.

An auxiliary air passage 4 forming part of the idle speed control system S is provided in a manner to bypass the throttle valve 3. More specifically, the auxiliary air passage 4 has one end connected to a portion of the throttle chamber 2 upstream of the throttle valve 3 and another end connected to another portion of the throttle valve 3 downstream of the throttle valve 3. An electromagnetically operated auxiliary air control valve 5 is controllably disposed in the auxiliary air passage 4. The throttle chamber 2 is connected to an intake manifold 6 having a collector section 6a to which manifold branch runners 6b are gathered with each other. The collector section 6a has a relatively large volume to be supplied with air which is to be distributed into the branch runners 6b. It will be understood that there are a plurality of branch runners 6b which are respectively communicable with a plurality of engine cylinders (not shown) of the engine 8 while only one branch runner 6b is shown in FIG. 1 for the purpose of simplicity of illustration. A fuel injector valve 7 is disposed in each branch runner 6b of the intake manifold located immediately upstream of an intake port (not shown) of each engine cylinder to inject fuel to be supplied into each engine cylinder.

With this intake system I, air passing through the air filter 1 is subjected to the controls of the throttle valve 3 and the auxiliary air control valve 5 and then flows through the intake manifold 6 toward the engine 8. At each manifold branch runner 6b, air is mixed with fuel injected from the fuel injector 7 to form air-fuel mixture which is to be sucked into each engine cylinder of the engine 8.

A control unit 9 forming part of the idle speed control system S is provided to output a control signal to control the opening degree of the auxiliary air control valve 5 electrically connected thereto. The control signal is determined in accordance with an engine operating condition. The control unit 9 is electrically connected to a crank angle sensor 10, a coolant temperature sensor 11, an idle switch 12, a neutral switch 13, and a vehicle speed sensor 14. The crank angle sensor 10 is adapted to output a reference signal REF at every predetermined crank angle of the engine 8. It will be understood that an engine speed Ne (rpm) of the engine 8 can be calculated depending upon a predetermined control cycle (or time period) Tref of the standard signal REF which cycle corresponds to a time duration between a standard signal REF and the next standard signal REF. The coolant temperature sensor 11 is adapted to detect the temperature Tw of an engine coolant for the engine 8 and to output a signal representative of the coolant temperature. The idle switch 12 is adapted to be switched ON to produce a signal when a transmission (not shown) is in a neutral position. The vehicle speed sensor 14 is adapted to detect a vehicle speed VSP of the automotive vehicle and outputs a signal representative of the vehicle speed.

Figure 2:
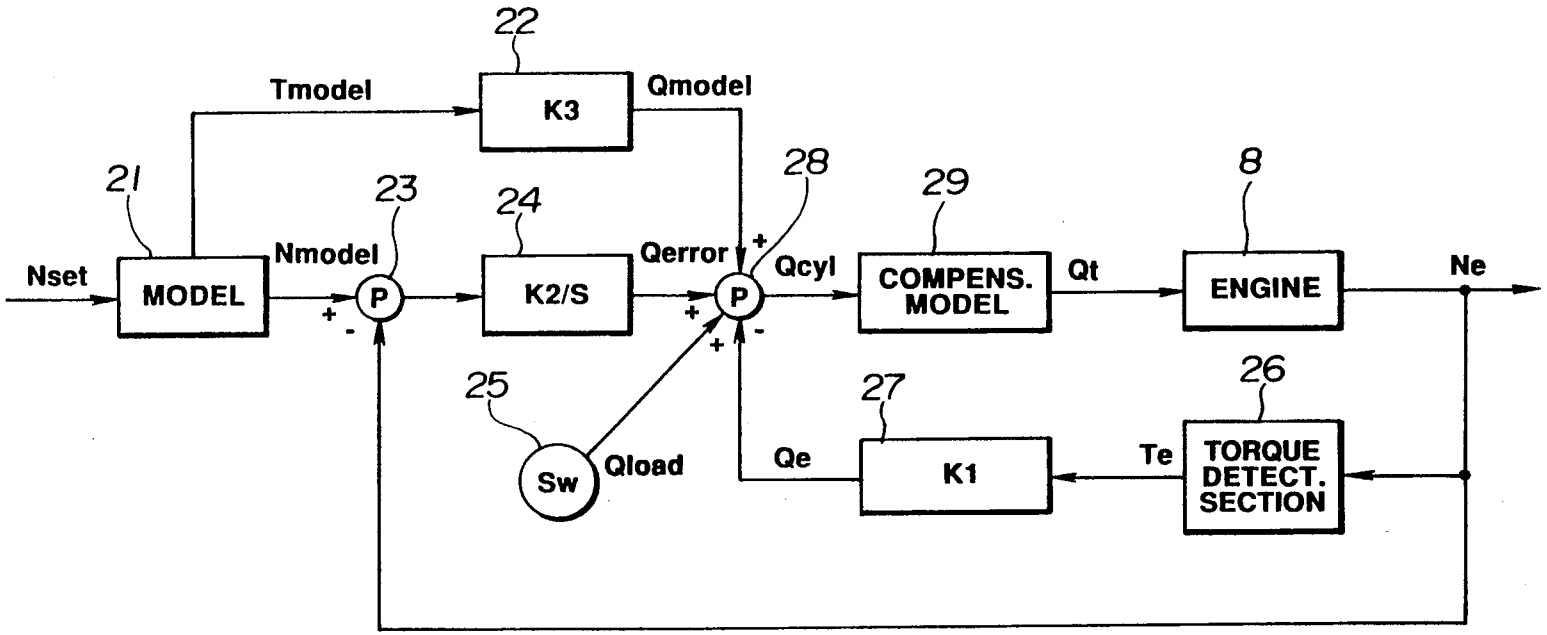
FIG. 2 is a block diagram showing a control of the idle speed control system of FIG. 1.

The control unit 9 includes a microcomputer and arranged to control the opening degree of the auxiliary air control valve 5 upon executing computing and processing operations in accordance with a control manner shown in FIG. 2, under an idle operating (idle speed feedback control) condition. The idle speed feedback control condition corresponds to a condition in which the idle switch 12 is switched ON, and the neutral switch 13 is switched ON, or to a condition in which the idle switch 12 is switched ON, and the vehicle speed VSP detected by the vehicle speed sensor 14 is not higher than a predetermined level (for example, 8 km/h).

The manner of operation of the idle speed control system of FIG. 1 will be discussed with reference to FIG. 2.

A target idle speed Nset is set depending upon the coolant temperature Tw and with reference to a map (not shown). The thus set target idle speed Nset is input to a model 21. The model 21 generates a model torque Tmodel and a model engine or idle speed Nmodel in time series, as follows:

First, a target angular velocity $\omega$ set is given by Eq.(1).

$$\omega\text{set deg/ms} = \text{Nset rpm} \times 360/60{,}000 \quad (1).$$

The torque T of a power output shaft (not shown) of the engine 8 is given by Eq.(2) on the basis of an angular velocity $\omega$ of the power output shaft.

$$T = I \times d\omega/dt \text{ deg/ms}^2 + C \times \omega\text{deg/ms} \quad (2)$$

where I is a virtual moment of inertia, and C is a coefficient of viscosity of oil.

Since $d\omega\text{model}/dt = 0$, and $\omega\text{model} = \omega\text{set}$ in a condition of t (time)—infinity, the model torque Tmodel at $\omega = \omega\text{model}$ is calculated according to Eq.(3).

$$T\text{model} = C \times \omega\text{set deg/ms} \quad (3).$$

Next, the model angular velocity $\omega$model will be obtained as follows:

The equation of state at a time the engine power output shaft torque makes a step response is represented as Eq.(4).

$$C \times \omega\text{set} = I \times d\omega\text{model}/dt \text{ deg/ms}^2 + C \times \omega\text{model deg/ms} \quad (4).$$

In case of calculating the model angular velocity $\omega$model within a time interval between a standard signal REF and the next standard signal REF (in which $\Delta t = \text{Tref}$) upon substitution of $d\omega\text{model}/dt = (\omega\text{model} - \omega\text{model}_{-1})/\Delta t$, the $\omega$model is represented by Eq.(5) in which $\omega$model represents the model angular velocity at the current control (computer computation) cycle while $\omega\text{model}_{-1}$ represents that at the prior control cycle.

$$\omega\text{model} = (C \times \omega\text{set} + (I/T\text{ref}) \times \omega\text{model}_{-1})/(C + I/T\text{ref}) \quad (5).$$

Accordingly, the model engine speed Nmodel can be calculated by Eq.(6).

$$N\text{model} = \omega\text{model} \times 60000/360 \quad (6).$$

The model torque Tmodel from the model 21 is converted to a model air amount (to be supplied to the engine cylinders) Qmodel by a transmitting element (K3) 22 and input to an addition point 28. It is to be noted that the torque T is proportional to Q (air amount)/N (engine speed) and therefore is a conversion of Qmodel = K3 × Tmodel × Nmodel is made.

The model engine speed Nmodel from the model 21 is input to an addition point 23 to which an actual engine or idle speed Ne detected by the crank angle sensor 10 is also input as a minus (−) component, thereby outputting an engine speed error component Nerror (= Nmodel − Ne). Then, the engine speed error component Nerror is integrated by a transmitting element (K2/S) 24 and converted into an air amount error component Qerror. The air amount error component Qerror is input to an addition point 28 and added to the model air amount Qmodel.

Furthermore, an ascertain disturbance Qload depending upon a load switch 25 such an air conditioner switch (a switch for operating an air conditioner in the automotive vehicle) is added to the model air amount Qmodel.

As shown in FIG. 2, a torque detecting section 26 is provided in the control circuit 9 to detect an actual torque Te of the power output shaft of the engine 8 as set forth below.

First, an angular velocity $\omega$ is obtained from an actual engine speed Ne as being given by Eq.(7).

$$\omega \text{deg/ms} = Ne \text{ rpm} \times 360/60000 \quad (7).$$

The engine power output shaft torque Te is given by Eq.(8) on the basis of the obtained angular velocity $\omega$.

$$Te \text{ kgm} = d\omega/dt = I \times d\omega/dt \text{ deg/ms}^2 + C \times \omega deg/ms \quad (8).$$

In case of calculating the torque Te within the interval between a standard signal REF and the next standard signal REF (in which $\Delta t = Tref$) upon making substitution of $d\omega/dt = (\omega - \omega_{-1})/Tref + C \times \omega$, the torque Te is given by Eq.(9) in which $\omega$ represents the angular velocity at the current control cycle while $\omega - 1$ represents that at the prior control cycle.

$$Te = I \times (\omega - \omega_{-1})/Tref + C \times \omega \quad (9).$$

The thus detected engine power output torque Te is input to a transmitting element (K1) 27 to be converted into an actual air amount (to be supplied to the engine cylinders) Qe. It is to be noted that the torque T is proportional to Q/N and therefore a conversion of $Qe = K1 \times Te \times Ne$ is made. This actual air amount Qe is added as a minus (−) component to the addition point 28.

At the addition point 28, a calculation of Eq.(10) is performed to obtain an increasing or decreasing amount Qcyl of air to be sucked into the engine cylinders of the engine 8. This increasing or decreasing air amount (or air amount correcting value) is referred to as cylinder-sucking air increasing or decreasing amount and corresponds to an air amount to be increased or decreased relative to the present amount of air to be sucked into the engine cylinders. The cylinder-sucking air increasing or decreasing amount is output to a compensation model 29.

$$Qcyl \text{ kg/h} = (Qmodel + Qerror + Qload) - Qe \quad (10).$$

The compensation model 29 functions to compensate an error due to the collector section 6*a* of the intake manifold 6. More specifically, the compensation model 29 makes a compensation of an air amount to be supplied to the collector section 6*a* in advance. Accordingly, the increasing or decreasing air amount Qcyl is converted by the compensation model 29 into an increasing or decreasing amount Qt of air flowing through the auxiliary air passage 4. This increasing and decreasing air amount Qt is referred to as an auxiliary air increasing or decreasing amount which is serves as an operational amount for operating the auxiliary air control valve 5.

The auxiliary air increasing or decreasing amount Qt is calculated according to Eq.(11), taking account of delay of air charging to the engine cylinders due to the intake manifold collector section 6*a*.

$$Qt \text{ kg/h} = Qcyl + Vt \times \omega \times (Qcyl - Qcyl_{-1}) \quad (11).$$

where $Vt = Vm/(Vc \times e \times 180)$ in which Vm is the volume of the collector section 6*a*; Vc is the total volume of cylinder(s) of the engine; e is a fresh air rate which is the rate (ratio) of fresh air in the cylinder(s); and $Qcyl_{-1}$ represents the auxiliary air increasing or decreasing amount at the prior control cycle while Qcyl represents that at the current control cycle.

The auxiliary air control valve 5 to be controlled is of the electromagnetically operated type, and therefore its opening degree or opening time duration is controlled in accordance with a duty cycle (factor). The duty cycle is represented by a time rate (%) of a pulse width relative to the predetermined control cycle, the pulse width being of a pulse signal or electric current to be supplied to the electromagnetic or solenoid coil (not shown) of the auxiliary air control valve 5. Accordingly, the auxiliary air increasing or decreasing amount Qt is added to a basic control value depending upon the coolant temperature Tw and then converted to the duty cycle (ISCon). When the duty cycle ISCon is thus decided, the solenoid coil of the auxiliary air control valve 5 is supplied with the electric current or pulse signal depending upon this duty cycle ISCon. As a result, the opening degree of the auxiliary air control valve 5 is controlled thereby to allow a required amount of air to be inducted into the cylinder(s) of the engine.

What is claimed is:

1. An idle speed control system for an internal combustion engine, comprising:

an auxiliary air control valve operatively disposed in an auxiliary air passage which is communicated at its downstream end with an intake air passageway downstream of a throttle valve; and means for controlling an amount of air flowing through said auxiliary air passage to control an idle speed of the engine under an idle operating condition, said air amount controlling means including means for producing a model torque of a power output shaft of the engine in time series, in accordance with a target idle speed by using a model, means for detecting a torque of the power output shaft, and means for controlling an opening degree of said auxiliary air control valve in accordance with a first difference between said model torque and said detected torque so as to control the air flowing amount in the auxiliary air passage.

2. An idle speed control system as claimed in claim 1, wherein said torque detecting means is adapted to determine said detected torque in accordance with an actual idle speed of the engine.

3. An idle speed control system as claimed in claim 1, wherein the opening degree of said auxiliary air control valve is a time duration, in a predetermined control cycle, at which said auxiliary control valve is opened to allow air to flow through said auxiliary air passage.

4. An idle speed control system as claimed in claim 1, further comprising means for producing a model idle speed in time series, in accordance with said target idle speed by using a model.

5. An idle speed control system as claimed in claim 4, wherein said controlling means is adapted to control the opening degree of said auxiliary air control valve in accordance with said first difference and also in accordance with said model idle speed.

6. An idle speed control system as claimed in claim 5, further comprising means for converting said model torque into a model air amount.

7. An idle speed control system as claimed in claim 6, further comprising means for converting said detected torque into an actual air amount.

8. An idle speed control system as claimed in claim 7, further comprising means for calculating a second difference between said model idle speed and an actual idle speed of the engine.

9. An idle speed control system as claimed in claim 8, further comprising means for converting said second difference into an air amount error component.

10. An idle speed control system as claimed in claim 9, said comprising means for determining an air amount correcting value in accordance with said difference and also in accordance with a third difference between the sum of said model air amount and said air amount error component and said actual air amount.

11. An idle speed control system as claimed in claim 10, wherein said opening degree control means includes means for controlling the auxiliary air control valve opening degree in accordance with said air amount correcting value.

12. An idle speed control system for an internal combustion engine comprising:

an auxiliary air control valve operatively disposed in an auxiliary air passage which is communicated at its downstream end with an intake air passageway downstream of a throttle valve; and means for controlling an amount of air flowing through said auxiliary air passage to control an idle speed of the engine under an idle operating condition, said air amount controlling means including means for producing a model torque of a power output shaft of the engine in time series, in accordance with a target idle speed by using a model, means for detecting a torque of the power output shaft, means for calculating a first difference between said model torque and said detected torque, means for producing a model idle speed in time series, in accordance with said target idle speed by using a model, means for calculating a second difference between said model idle speed and an actual idle speed of the engine, and means for controlling an opening degree of said auxiliary air control valve in accordance with said first difference and said second difference so as to control the air flowing amount in the auxiliary air passage.

* * * * *